United States Patent [19]

Boller

[11] 4,441,871

[45] Apr. 10, 1984

[54] ROTARY COMPRESSORS WITH PRIMARY AND SECONDARY OIL SEPARATION MEANS

[75] Inventor: Edward Boller, Lapal, England

[73] Assignee: Hydrovane Compressor Company Limited, United Kingdom

[21] Appl. No.: 336,354

[22] Filed: Dec. 18, 1981

[51] Int. Cl.[3] ..... F04C 29/02; B01D 45/06; B01D 46/24

[52] U.S. Cl. ..... 418/97; 418/DIG. 1; 55/309; 55/320; 55/437; 55/498

[58] Field of Search ..... 418/97, DIG. 1, 98–100; 55/309, 320, 437, 498, 523

[56] References Cited

U.S. PATENT DOCUMENTS

| | | | |
|---|---|---|---|
| 2,047,728 | 7/1936 | Erling | 55/437 |
| 2,272,926 | 2/1942 | Squiller | 418/DIG. 1 |
| 3,191,854 | 6/1965 | Lowler et al. | 418/85 |
| 3,436,898 | 4/1969 | Kaess et al. | 55/523 |
| 4,050,237 | 9/1977 | Pall et al. | 55/498 |

FOREIGN PATENT DOCUMENTS

| | | | |
|---|---|---|---|
| 2516582 | 10/1975 | Fed. Rep. of Germany . | |
| 2392256 | 12/1978 | France . | |
| 783340 | 9/1957 | United Kingdom . | |
| 925490 | 5/1963 | United Kingdom . | |
| 1134224 | 11/1968 | United Kingdom . | |
| 1318884 | 5/1973 | United Kingdom | 418/DIG. 1 |
| 1402435 | 8/1975 | United Kingdom . | |
| 1486942 | 9/1977 | United Kingdom . | |
| 2020750 | 11/1979 | United Kingdom . | |

OTHER PUBLICATIONS

Pages 22–24 of Publication by Works Engineering & Factory Services, Published May, 1968.

*Primary Examiner*—John J. Vrablik

*Attorney, Agent, or Firm*—Price, Heneveld, Huizenga & Cooper

[57] ABSTRACT

An air compressor wherein oil mist lubricates a rotor stator in the compressor casing whereby an oil mist is produced in the compressed air provided with primary and secondary oil removal sections. The primary and secondary oil removal sections are connected by an oil separation manifold. The manifold and the secondary oil removal section are in a housing detachable from the main compressor housing. The main and detachable housings communicate with a tube which has apertures in its side wall at its inlet end which end communicates with the interior of the main housing and apertures in its side wall at its outlet end which end communicates with the manifold.

13 Claims, 4 Drawing Figures

ROTARY COMPRESSORS WITH PRIMARY AND SECONDARY OIL SEPARATION MEANS

TECHNICAL FIELD

The invention relates to rotary oil mist compressors, and is particularly concerned with the separation of the oil from the compressed air.

The term oil mist compressor is used herein to refer to those compressors, e.g. of eccentric rotor sliding vane type or of screw type in which oil is injected into the air to be compressed and is subsequently separated from the compressed air, the separated oil being returned to the air inlet or sump of the compressor.

BACKGROUND ART

Eccentric rotor sliding vane compressors generally separate the entrained oil from the air in two stages. The primary stage may consist of a tortuous passage or an impingement shield situated adjacent the outlets from the rotor stator unit, and a proportion of the oil droplets are induced to coalesce on the surface of the passage or the impingement shield and are then returned to the sump. The secondary separation stage may consist of one or more felt pads or other filtering or coalescing media adapted to remove the majority of the remaining oil from the compressed air. It is desirable that the separation of the oil from the compressed air be as efficient as possible, firstly because it is frequently inconvenient for the compressed air to have a significant amount of entrained oil in it, and secondly because oil that is not separated is lost and must subsequently be replaced.

DISCLOSURE OF THE INVENTION

According to the present invention there is provided a rotary oil mist compressor having a rotor stator unit in which, in use, air is compressed and oil is injected into the air and includiung a primary oil separation means for removing a proportion of the entrained oil from the air and a secondary oil separation means for removing substantially the remainder of the oil, the primary and secondary oil separation means being connected by a pathway including a secondary separation manifold, in which, in use, oil droplets coalesce and collect, there being an oil return passageway communicating with the manifold adapted to return the oil collected in the manifold back to the compressor casing for re-use. Preferably the pathway is so constructed that, in use, the air is constrained to flow through a substantial angle when flowing into the secondary separation manifold and a further substantial angle when flowing out of the manifold. The substantial angles are preferably substantially 90°, and the pathway preferably includes three and more preferably four such angles or bends.

At each of these bends the acceleration and turbulence of the gas that is caused results in the coalescing and deposition of a proportion of the entrained oil thus reducing the separation load to which the secondary separation means is subjected and thus increasing the separation efficiency and service life of the secondary separation means. The oil which is deposited in the secondary separation manifold is then returned to the compressor casing, e.g. to the sump of the casing and this is preferably effected under the action of the pressure of the compressed air itself.

The secondary separation means preferably comprises one or more tubular coalescing elements, of e.g. ceramic material communicating with the interior of the secondary separation manifold and these are preferably arranged with their axes vertical. This latter feature is found to be preferably to arranging the tubular coalescing elements with their axes horizontal as is conventional since the oil trickles rapidly downwards and results in a greater proportion of the elements being unclogged with oil and thus available for separation. The secondary separation manifold thus preferably extends horizontally, e.g. parallel to the rotor axis and the compressed air flows along it and then turns through substantially 90° to flow into the or each coalescing element.

In the preferred embodiment the or each coalescing element has within it a tube into which the compressed air is constrained to flow, the or each tube having a plurality of spaced apertures in its wall. Thus the compressed air turns through 90° to enter the tube within the coalescing elements and is constrained to turn through a further bend of 90° when leaving the tube prior to actually passing through the wall of the coalescing element. The apertures also distribute the air, and thus the oil separation load, over substantially the entire area of the or each coalescing element thus further increasing the oil separation efficiency. The or each tube preferably projects into the secondary separation manifold so that separated oil present in the manifold is out of the main air flow and thus not prone to being re-entrained by the flow of the compressed air.

In the preferred embodiment the rotor stator unit and the primary separation means are situated in a compressor housing and the secondary separation means is situated in a separate housing detachably secured to the compressor housing. The removability of the secondary separation housing facilitates exchange and servicing of the coalescing elements.

Preferably the secondary separation housing has a compressed air outlet at its upper end. The compressed air will therefore pass through the coalescing elements and then up to the outlet, while the coalesced oil will trickle downwards. This will mean that the oil will accumulate in a comparatively calm area of the secondary separation housing thus reducing the risk that it be re-entrained by the compressed air. The compressor preferably includes a removable hollow oil return member, e.g. a bolt, which preferably extends into, and whose interior communicates with that of, the secondary separation manifold through which oil is returned for re-use. If the oil return member should become blocked it may be removed, cleared and replaced.

Further features and details of the invention will be apparent from the following description of one specific embodiment which will be given by way of example with reference to the accompanying drawings.

BEST MODE OF CARRYING OUT THE INVENTION

Figure 1:
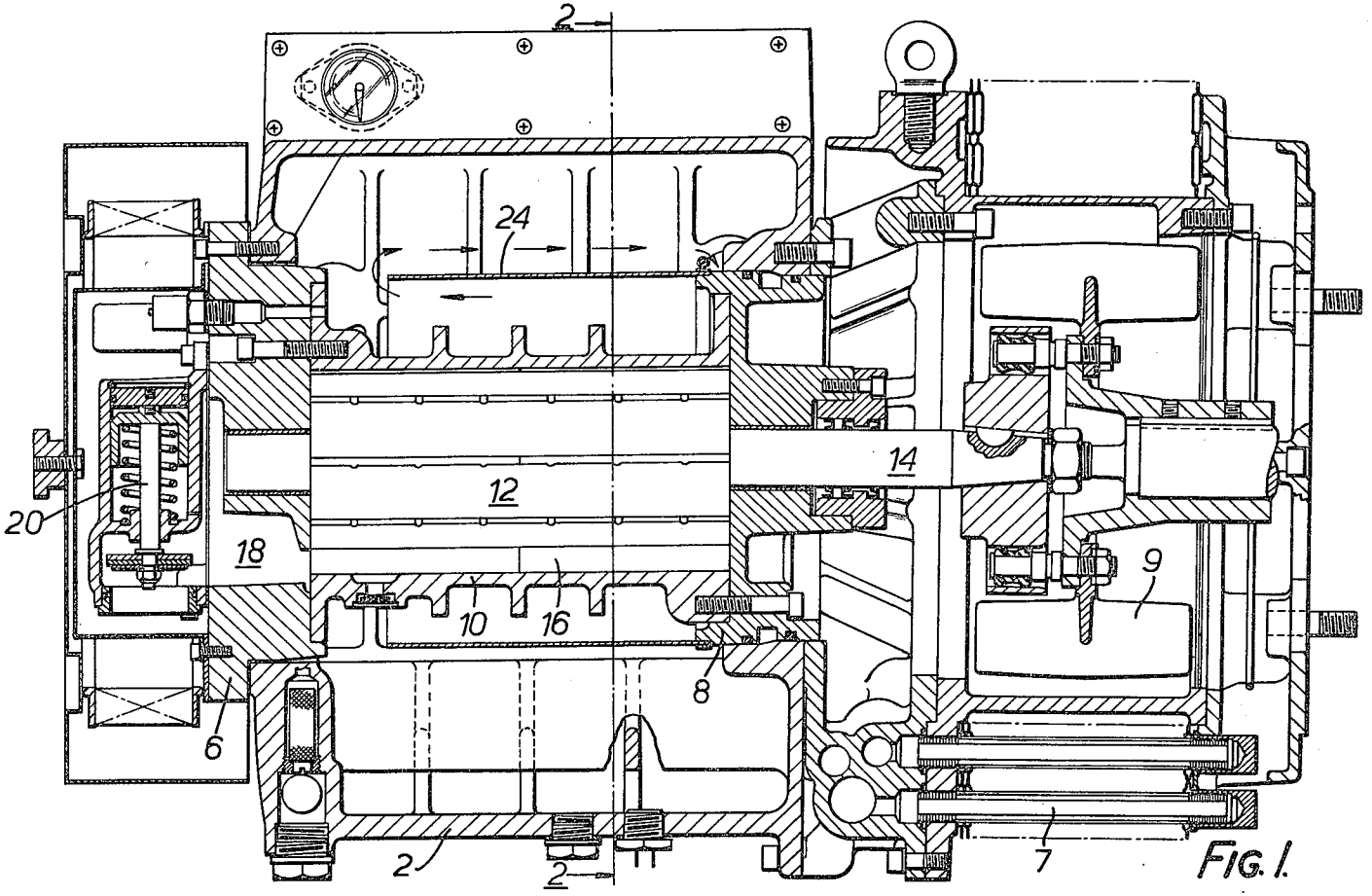
FIG. 1 is a longitudinal section through the compression section of a sliding vane eccentric rotor compressor.

The compressor is of eccentric rotor sliding vane type having a compression section, seen in FIG. 1, within a housing 2 removably connected to the side of which by bolts 3 is a separate secondary oil separation section within a housing 4.

The compression section of the compressor does not differ significantly from known constructions and will therefore only be described briefly. The housing 2 is closed by two removable end plates 6 and 8 between which a stator 10 is secured. Eccentrically mounted within the stator is rotor 12 which may be rotated by a drive shaft 14 and which leaves a crescent shaped working space within the stator. A series of longitudinal slots are formed in the rotor each of which accommodates a sliding vane 16. The lower portion of the casing 2 defines an oil sump. During operation of the compressor the oil is circulated by virtue of the compressor pressure through one or more oil coolers 7 in which the oil is cooled by virtue of an air flow caused by fan blades 9 on the drive shaft 14.

In use the rotor is rotated and the vanes are kept in contact with the interior of the stator by centrifugal force. Air is drawn into the stator through an inlet 18 which is controlled by an unloader valve 20 of known type. Oil is withdrawn from the sump and injected into the crescent shaped working space within the stator which ensures an adequate gas seal between the vanes and the stator and the end plates. The air within the crescent shaped working space is compressed as the rotor rotates, and the compressed air exits through a series of outlet ports 22 in the upper part of the stator.

Figure 2:
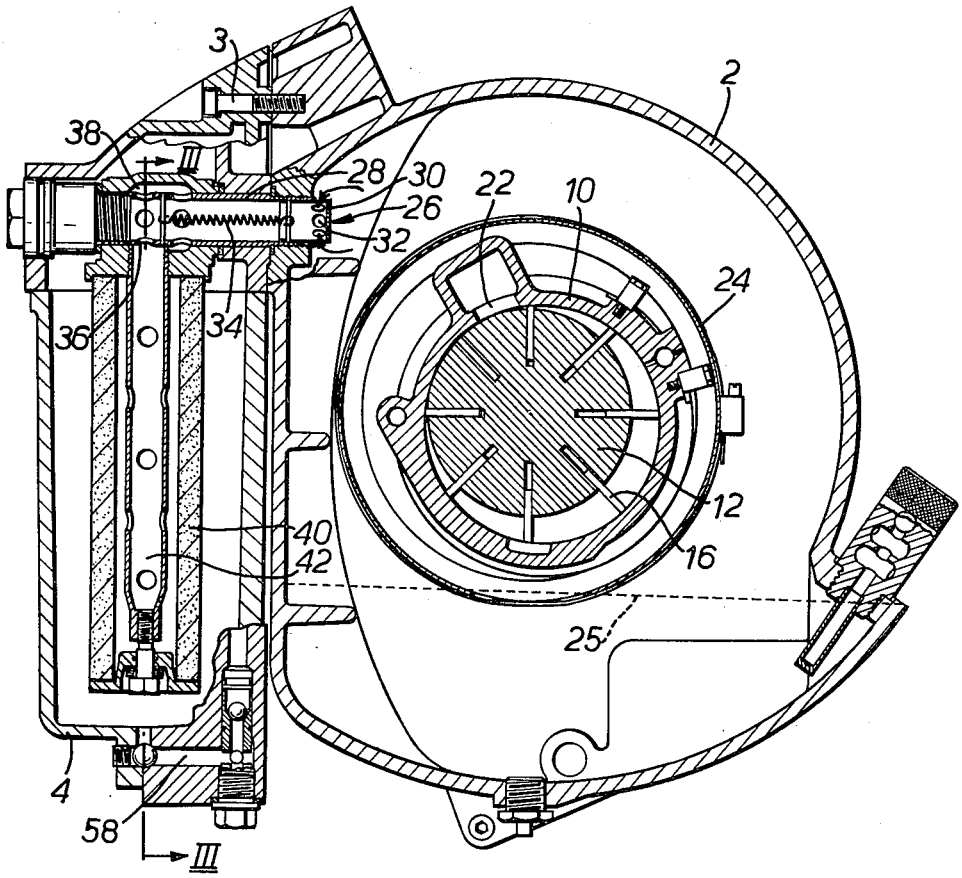
FIG. 2 is a non-planar axial section through the compressor which passes through the lines 2—2 in FIG. 1 and II—II in FIG. 3.
Figure 3:
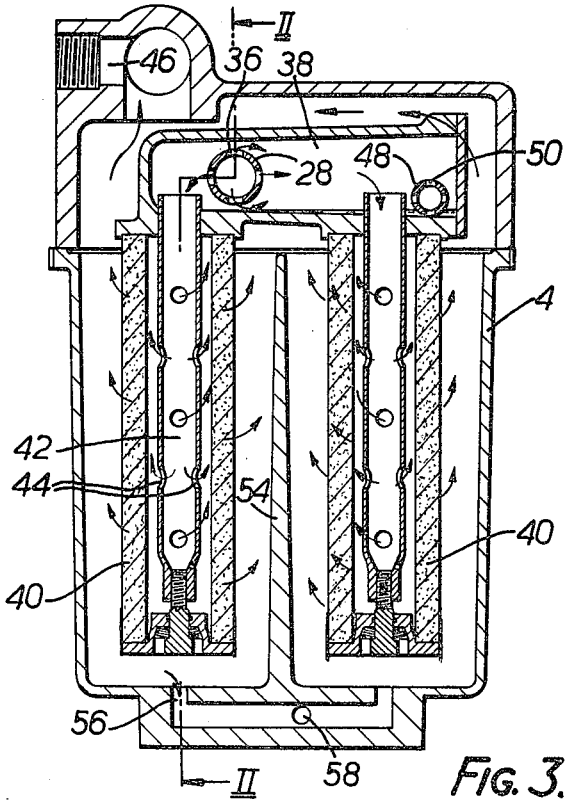
FIG. 3 is a longitudinal section through the secondary separation section of the compressor along the line 3—3 in FIG. 2.

Surrounding the stator and coaxial with it is an impingement shield 24 which constitutes the primary separation section connected to the right hand end plate 8 which extends down below the oil level in the sump as indicated by the dotted line marked 25 in FIG. 2. A large proportion of the entrained oil droplets in the compressed air coalesce on the impingement shield and drip down to the sump and the air with the remaining entrained oil droplets flows to the left, as seen in FIG. 1 and thence around the end of the impingement shield and back to the right. This deceleration and change of direction causes further entrained oil droplets to coalesce and drip down to the sump. The air then passes towards and out through an outlet 26 into the secndary separation section.

The outlet 26 is a thermally actuated shut-off valve of the type described in British patent specification No. 1218769 and comprises a fixed tube 28 at the inlet end of which is a cap 30 having a closed end and apertures 32 formed in its side wall which fits inside the wall of the tube 28. A spring 34 urges the cap into the closed position in which no gas can pass in through the apertures 32. In use, the cap 30 is secured in the open position by solder so that air can flow into it. If however the temperature of the compressed air should rise above a predetermined vlaue the solder melts and the tube is closed by the cap 30 under the action of the spring 34. The compressor pressure will then rise rapidly and the compressor will be throttled down by the unloader valve and then optionally turned off altogether by control means (not shown).

At the downstream end of the tube 28 there are eight outlet apertures 36 which communicate with a secondary separation manifold 38. Below the manifold 38 within the housing 4 there are two vertically arranged tubular ceramic secondary separation oil filters or coalescing elements 40 whose lower ends are closed and which are connected at their upper ends with opposite ends of the manifold 38. Within each coalescing element there is a coaxially disposed metallic tube 42 whose lower end is closed, whose upper end communicates with the interior of the manifold 38 and is provided with a plurality of outlet apertures 44 spaced around its periphery and along its length. Compressed air in the manifold 38 therefore passes down into the tubes 42, through the outlet apertures 44 and thence through the walls of the ceramic tubes 40 along substantially their entire length. The gas then passes upwardly in the housing 4 and out through an outlet 46.

Figure 4:
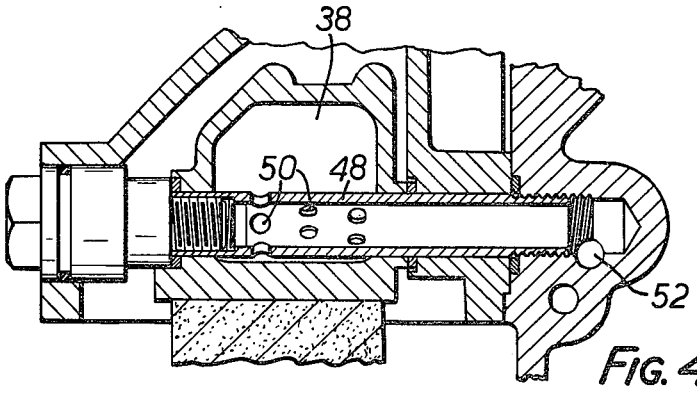
FIG. 4 is a scrap sectional view through the oil return bolt in the secondary separation manifold.

Situated in the manifold 38 is an oil return bolt comprising a hollow tubular bolt 48, seen in FIG. 4, in the wall of which a number of apertures 50 are formed. Entrained oil that is coalesced and separated from the gas in the manifold flows through the apertures 50 and is then returned to the sump by the compressor pressure through a bore 52.

The two ceramic elements 40 are separated by a baffle 54 upstanding from the floor of the housing 4. Oil separated by the ceramic elements drips down on to the floor and then into a respective oil return aperture 56 whence it is returned to the sump by the compressor pressure through a common oil return bore 58.

In use, the air is compressed as described above and a considerable proportion of the entrained oil is coalesced against the primary separation means constituted by the primary impingement shield 24 and drips down to the sump. The air then passes round the end of the impingement shield 28 turning through 180°, as shown by the arrows in FIG. 1, the acceleration and turbulence caused thereby resulting in further coalescing and deposition of oil. The air then passes through one of the apertures 32 into the tube 28, thereby turning through a further 90°. Any oil that is coalesced during this turn will also drip down to the sump or will sink to the bottom of the tube 28. The flow path of the air then turns through a further 90° when passing through one of the apertures 36 into the manifold 38. Oil coalesced at this point will be deposited in the manifold 38, or in the tube 28 whence it will drip into the manifold. The air in the manifold then passes into one or other of the tubes 42, thus turning through a further bend of about 90°. The air then further passes through one of the apertures 44 in the tubes 42, turning through a further 90° bend and then through the material of the ceramic elements 40, where substantially all the remaining entrained oil is coalesced. Finally the air passes upwards and then out through the outlet 46. Oil that is deposited within the manifold 38 is returned to the sump by the oil bolt 48 as described above, whilst oil coalesced by the ceramic elements 40 flows downwardly, drips onto the floor of the housing 4 and is returned to the sump via the bore 58.

The compressor in accordance with the invention provides compressed air that is substantially free of entrained oil because oil is separated from the air not only in the primary and secondary separation areas but also in the pathway between these two areas by virtue of the great number of bends in the pathway. Much of this oil is deposited or accumulated in the secondary separation manifold and it is then returned for re-use by a separate oil return passage and not re-entrained by the compressed air. If one or more of the ceramic elements should become clogged it may simply be replaced by removing the lower portion of the housing 4. The entire housing 4 is detachable from the remainder of the compressor which facilitates access and servicing. It will be appreciated that any desired number of ceramic elements may be used according to requirements and in addition these may be arranged in series rather than in parallel. Although the invention has been described with reference to an eccentric rotor sliding vane compressor it will be appreciated that the invention is also applicable to, e.g. screw compressors.

I claim:

1. A rotary oil mist compressor having a compressor casing, a rotor stator unit within the casing for compressing air into which oil has been injected, said compressor including a primary oil separation means for removing a portion of the entrained oil from the compressed air and a secondary oil separation means for removing substantially the remainder of the entrained oil, a compressor housing, the rotor stator unit and the primary separation means being situated within the compressor housing; a separate housing detachably secured to the compressor housing and said secondary separation means being situated in the separate housing, the primary and secondary oil separation means being connected by a pathway characterised in that the pathway includes a secondary separation manifold, in which oil droplets coalesce and collect, an oil return passageway communicating with the manifold and the compressor casing for returning the oil collected in the manifold to the compressor casing for re-use and a primary tube communicating between the compressor housing and the secondary separation housing, said primary tube having apertures in its side wall at its inlet end communicating with the interior of the compressor housing and apertures in its side wall at its outlet end communicating with the secondary separation manifold, the axis of said inlet and outlet apertures being at a substantial angle to the longitudinal axis of said tube.

2. A compressor as claimed in claim 1 wherein said pathway is at a substantial angle to the stream of air flowing out of the secondary separation manifold into the secondary oil separation means.

3. A compressor as claimed in claim 1 further characterised in that the secondary separation means comprises at least one tubular coalescing element arranged with its axis substantially normal to the axis of said tube; a secondary tube within each coalescing element into which the compressed air is constrained to flow, said secondary tube being spaced from the interior of the associated coalescing element and having a plurality of spaced apertures in its wall.

4. A compressor as claimed in claim 3 further characterised in that the axis of said second tube is substantially vertical.

5. A compressor as claimed in claim 2 further characterised in that the secondary separation means comprises at least one tubular coalescing element arranged with its axis substantially vertical and a secondary tube within each coalescing element into which the compressed air is constrained to flow, said secondary tube being spaced from the interior of the associated coalescing element and having a plurality of spaced apertures in its wall.

6. A compressor as claimed in claim 3 wherein said secondary manifold is horizontally disposed and said secondary tube projects into the secondary separation manifold through the bottom thereof so that the top of said secondary tube projects above the bottom of said manifold, said coalescing elements being below said secondary manifold.

7. The compressor as claimed in claim 6 wherein said oil return passageway communicates with said secondary manifold at a point below the top of said secondary tube whereby the oil coalesced in the bottom of said secondary manifold will not drain into said secondary tube.

8. A compressor as claimed in claim 1 further characterised in that a thermally responsive valve is incorporated in the air flow path, the primary tube between the compressor housing and the secondary separation housing being part of said thermally responsive valve.

9. A compressor as claimed in claim 2 further characterised in that a thermally responsive valve is incorporated in the air flow path, the primary tube between the compressor housing and the secondary separation housing being part of said thermally responsive valve.

10. A compressor as claimed in claim 3 further characterised in that a thermally responsive valve is incorporated in the air flow path, the primary tube between the compressor housing and the secondary separation housing being part of said thermally responsive valve.

11. A compressor as claimed in claim 5 further characterised in that a thermally responsive valve is incorporated in the air flow path, the primary tube between the compressor housing and the secondary separation housing being part of said thermally responsive valve.

12. A compressor as claimed in claim 6 further characterised in that a thermally responsive valve is incorporated in the air flow path, the primary tube between the compressor housing and the secondary separation housing being part of said thermally responsive valve.

13. A compressor as claimed in claim 7 further characterised in that a thermally responsive valve is incorporated in the air flow path, the primary tube between the compressor housing and the secondary separation housing being part of said thermally responsive valve.

* * * * *